US007345649B2

(12) United States Patent
Ko et al.

(10) Patent No.: US 7,345,649 B2
(45) Date of Patent: Mar. 18, 2008

(54) SPIRAL-PATTERNED INTERNAL ANTENNA HAVING OPEN STUB AND PERSONAL MOBILE TERMINAL EQUIPPED WITH THE SAME

(75) Inventors: Young-Joon Ko, Seoul (KR); Hong-Teuk Kim, Youngin-si (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 11/344,636

(22) Filed: Jan. 31, 2006

(65) Prior Publication Data

US 2006/0170611 A1 Aug. 3, 2006

(30) Foreign Application Priority Data

Feb. 1, 2005 (KR) ..... 10-2005-0009170

(51) Int. Cl.
*H01Q 1/36* (2006.01)

(52) U.S. Cl. ..... 343/895; 343/702

(58) Field of Classification Search ..... 343/702, 343/895

See application file for complete search history.

(56) References Cited

U.S. PATENT DOCUMENTS 5,929,825 A * 7/1999 Niu et al. ..... 343/895
6,166,694 A * 12/2000 Ying ..... 343/702
6,295,029 B1 * 9/2001 Chen et al. ..... 343/700 MS
6,329,962 B2 * 12/2001 Ying ..... 343/895
6,353,443 B1 * 3/2002 Ying ..... 715/702
6,930,640 B2 * 8/2005 Chung et al. ..... 343/700 MS
2004/0125026 A1 * 7/2004 Pathak et al. ..... 343/702
2005/0007283 A1 * 1/2005 Jo et al. ..... 343/702

* cited by examiner

*Primary Examiner*—Tan Ho
(74) *Attorney, Agent, or Firm*—Lee, Hong, Degerman, Kang & Schmadeka

(57) ABSTRACT

The present invention relates generally to a spiral-patterned internal antenna having an open stub and a personal mobile terminal equipped with the same and, more particularly, to the pattern of an open stub. The spiral-patterned internal antenna of the present invention includes a main part having a spiral pattern; and an open stub connected to the main part. According to the present invention, an antenna for a terminal can be constituted regardless of the shape of a rear casing by using a spiral-patterned antenna having an open stub, and a highly efficient antenna can be formed using the suggested open stub.

7 Claims, 8 Drawing Sheets

Fig. 4
| Antenna Type | (a) | (b) | (c) |
|---|---|---|---|
| Frequency | 0.987 GHz | 0.92 GHz | 0.992 GHz |
| Radiation efficiency | 86 % | 66% | 76% |
Fig. 5a
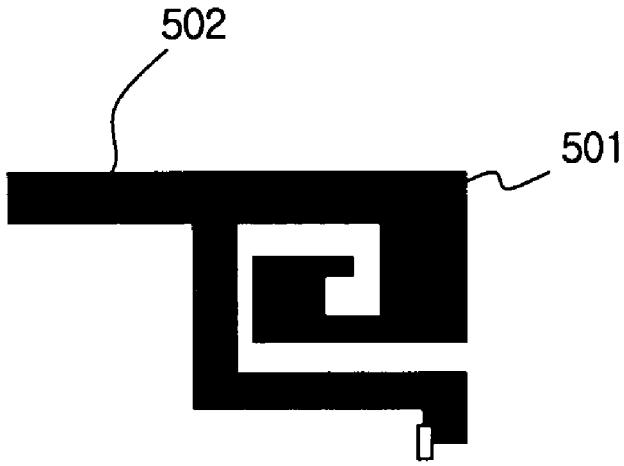
Fig. 5b
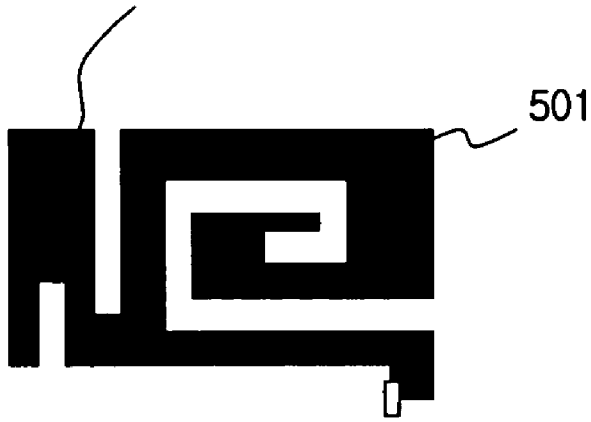

SPIRAL-PATTERNED INTERNAL ANTENNA HAVING OPEN STUB AND PERSONAL MOBILE TERMINAL EQUIPPED WITH THE SAME

Pursuant to 35 U.S.C. § 119(a), this application claims the benefit of earlier filing date and right of priority to Korean Patent Application No. 10-2005-0009170 filed on Feb. 1, 2005, which is hereby incorporated by reference herein in its entirety.

BACKGROUND OF THE INVENTION

1. Field of the Invention Equipped

The present invention relates generally to a spiral-patterned internal antenna having an open stub and a personal mobile terminal equipped with the same and, more particularly, to the pattern of an open stub.

2. Description of the Related Art

As wireless mobile communication technologies develop, many products, such as a wireless portable mobile communication terminal and a Personal Digital Assistant (PDA), have been introduced, and antennas are principal communication parts that determine the performance of such wireless communication products. External monopole or helical antennas are mainly used as antennas applied to existing wireless portable mobile communication terminals. However, the external antennas have many disadvantages in that their characteristics may be changed by users if the external antennas are not fixed, the external antennas restrict the designs of wireless portable mobile communication terminals and PDAs, and their appearances are not beautiful. The selection of internal antennas is necessary to resolve the disadvantages of the external antennas. However, wireless portable mobile communication terminals and PDAs have spatial limitations, the application of internal antennas thereto is difficult.

Existing internal antennas applied to wireless portable mobile communication terminals are mainly Planar Inverted F-Antennas, and ceramic chip antennas and PIFA type-antennas are used as antennas for wireless PDAs.

The above-described PIFA antennas have narrow bandwidth, so that the radiation efficiency thereof decreases due to reflection loss at an input terminal, and resonance characteristics are exhibited at ¼ wavelength, and, thus, they have a disadvantage in that the size thereof increases. The ceramic chip antennas applied to wireless PDAs are made of high-dielectric material, so that they have a disadvantage in that the radiation efficiency thereof decreases.

SUMMARY OF THE INVENTION

Accordingly, the present invention has been made keeping in mind the above problems occurring in the prior art, and an object of the present invention is to provide a small-size and high-performance internal antenna and a wireless portable mobile communication terminal and a PDA equipped with the same.

In order to accomplish the above object, the present invention provides a spiral-patterned internal antenna, including a main part having a spiral pattern; and an open stub connected to the main part.

Preferably, in the present invention, the spiral-patterned internal antenna further includes a feeding point located on one side of the main part and connected to an internal circuit of a mobile communication terminal, the feeding point comprises a feeding part for supply of current to the main part and a ground part for electrical ground of the main part, and the feeding part and the ground part is adjacent to each other.

Preferably, in the present invention, the spiral pattern of the main part forms 1.5 or more turns.

Preferably, in the present invention, the open stub is connected to an outermost arm of the spiral pattern of the main part or to a 0.5-turn portion of the spiral pattern of the main part.

Preferably, in the present invention, the length L of the open stub determines a resonant frequency of the antenna.

Preferably, in the present invention, the length L of the open stub determines a resonant frequency of the antenna. 10.

Preferably, in the present invention, the open stub has one shape selected from 'u', 'n', 'W', '7' and 'L' shapes.

Preferably, in the present invention, the outer shape of the antenna, having the main part with the spiral pattern and the open stub connected to the main part, is determined depending on an appearance of a casing of a mobile communication terminal to be equipped with the main part and the open stub.

BRIEF DESCRIPTION OF THE DRAWINGS

The above and other objects, features and advantages of the present invention will be more clearly understood from the following detailed description taken in conjunction with the accompanying drawings, in which:

FIG. 4 is a table showing the characteristics of the radiation efficiency of the antennas illustrated in FIGS. 2A to 2C;

FIGS. 5A to 5C are diagrams illustrating the structures of internal antennas, which various types of open stubs according to an embodiment of the present invention are respectively applied;

DESCRIPTION OF THE PREFERRED EMBODIMENTS

Figure 1:
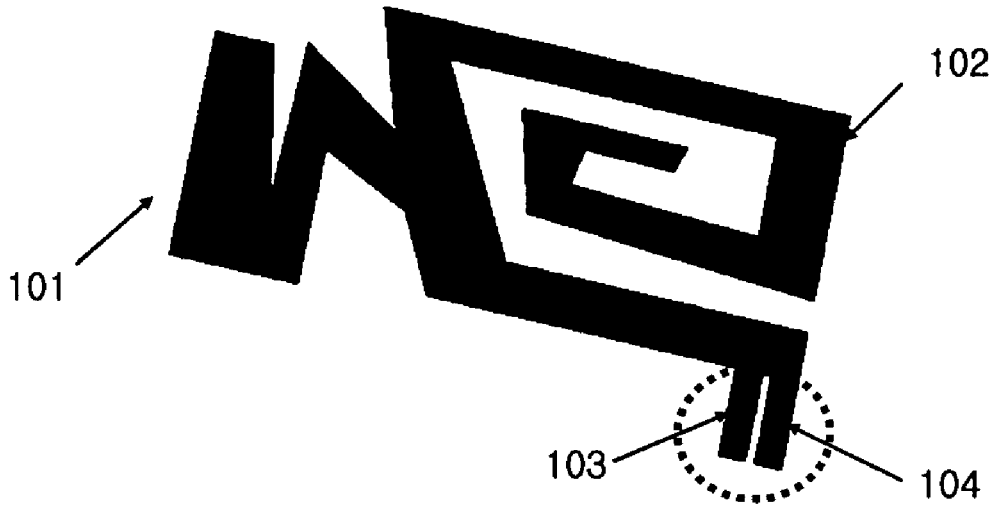
FIG. 1 is a diagram illustrating the structure of an internal spiral antenna having an open stub according to an embodiment of the present invention.

Reference now should be made to the drawings, in which the same reference numerals are used throughout the different drawings to designate the same or similar components.

FIG. 1 is a diagram illustrating the structure of a spiral-patterned internal antenna having an open stub according to an embodiment of the present invention.

In this embodiment, the internal antenna includes a main part 102, that is, a spiral pattern, an open stub 101, a feeding part 103 and a ground part 104.

In the drawing, the connection of the open stub 101 to the spiral pattern 102 is schematically illustrated.

Referring to FIG. 1, the structure of the spiral-patterned antenna having the suggested open stub 101 is illustrated. The antenna, which is connected to the internal circuit of a terminal via a feeding point (circular dotted line), propagates signals while generating current in the spiral pattern 102 and the open stub 101. A resonant frequency band is determined depending on the total length of the spiral pattern 102 and the open stub 101. The spiral pattern 102 must have the number of turns that is at least 1.5. The open stub 101 may be connected to any point on the outermost arm of the spiral pattern 102. However, it is preferred that the open stub 101 be connected to a portion on which 0.5 turns are formed, and the shape of the open stub 101 has a shape that has the minimum area and the maximum length. The shape of the open stub 101 may be variously implemented by those skilled in the art, but it is preferable to select one from 'u', 'n', 'W', '7' and 'L' shapes.

Figure 2A:
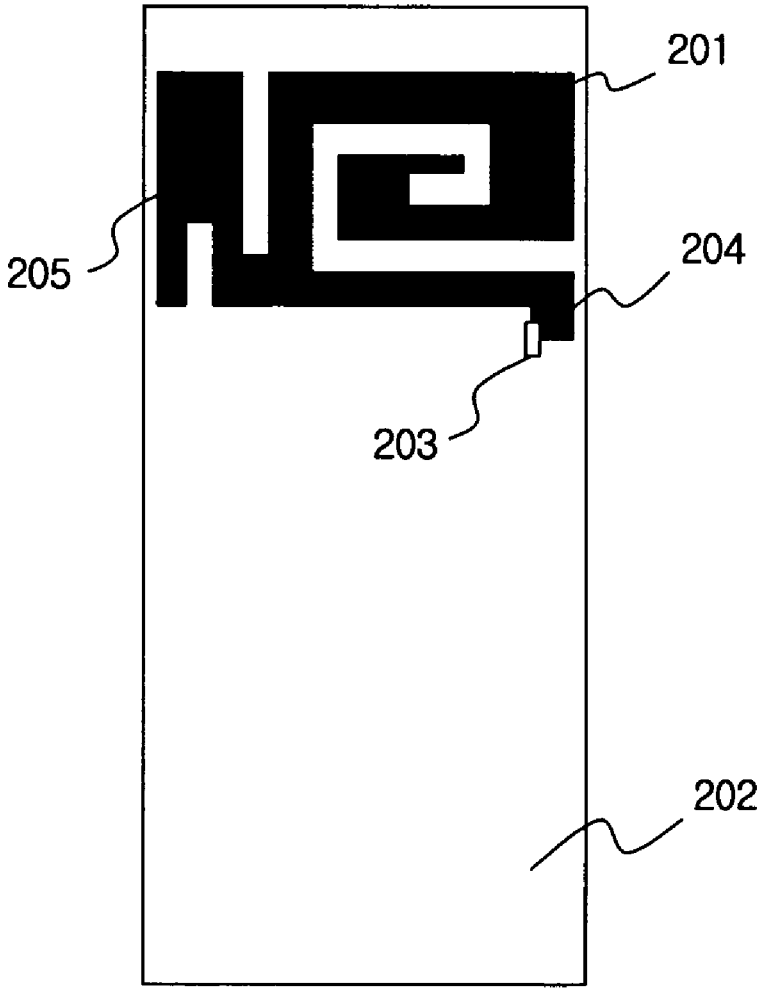
FIGS. 2A to 2C are diagrams the structures of internal antennas.
Figure 2B:
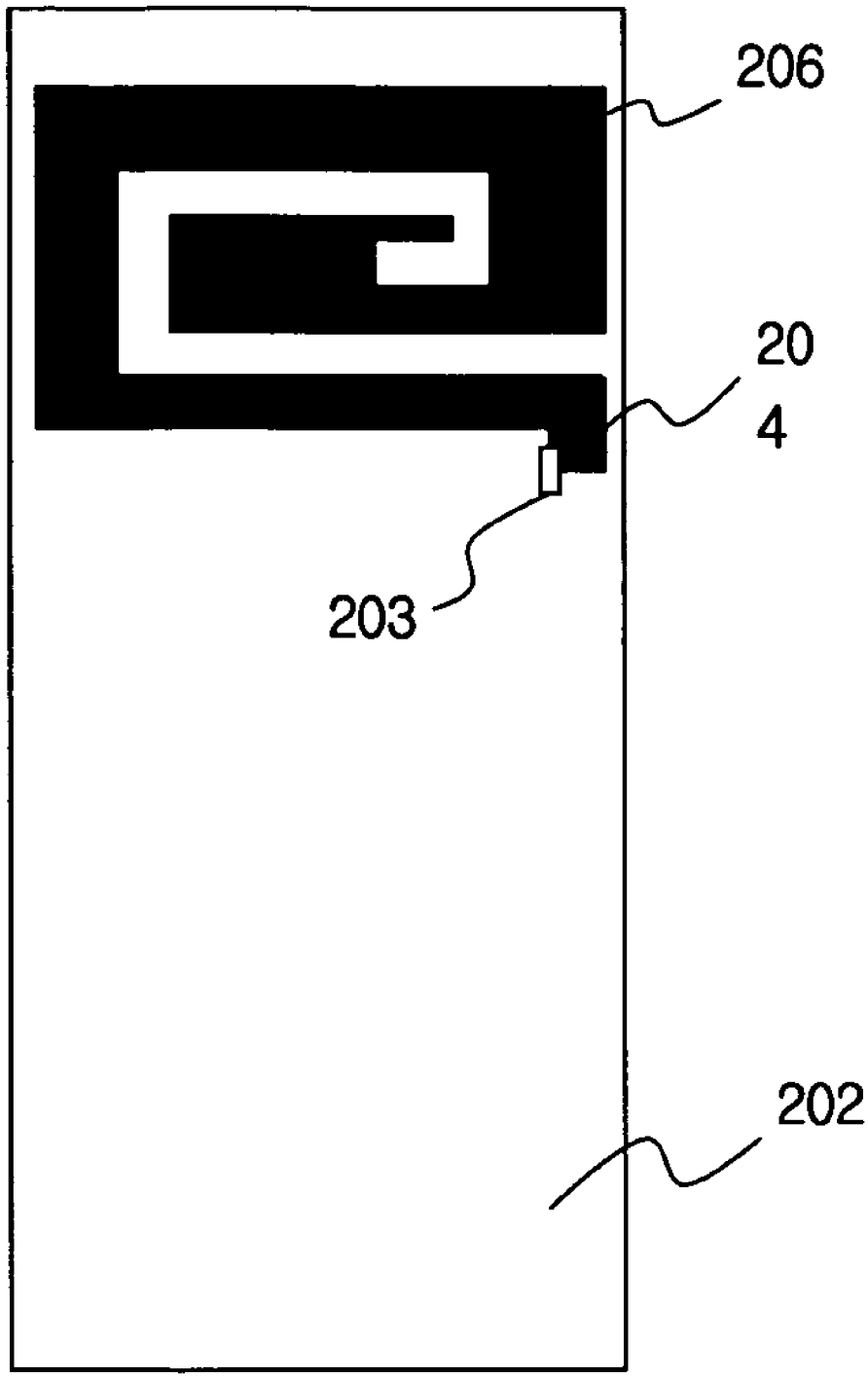
Figure 2C:
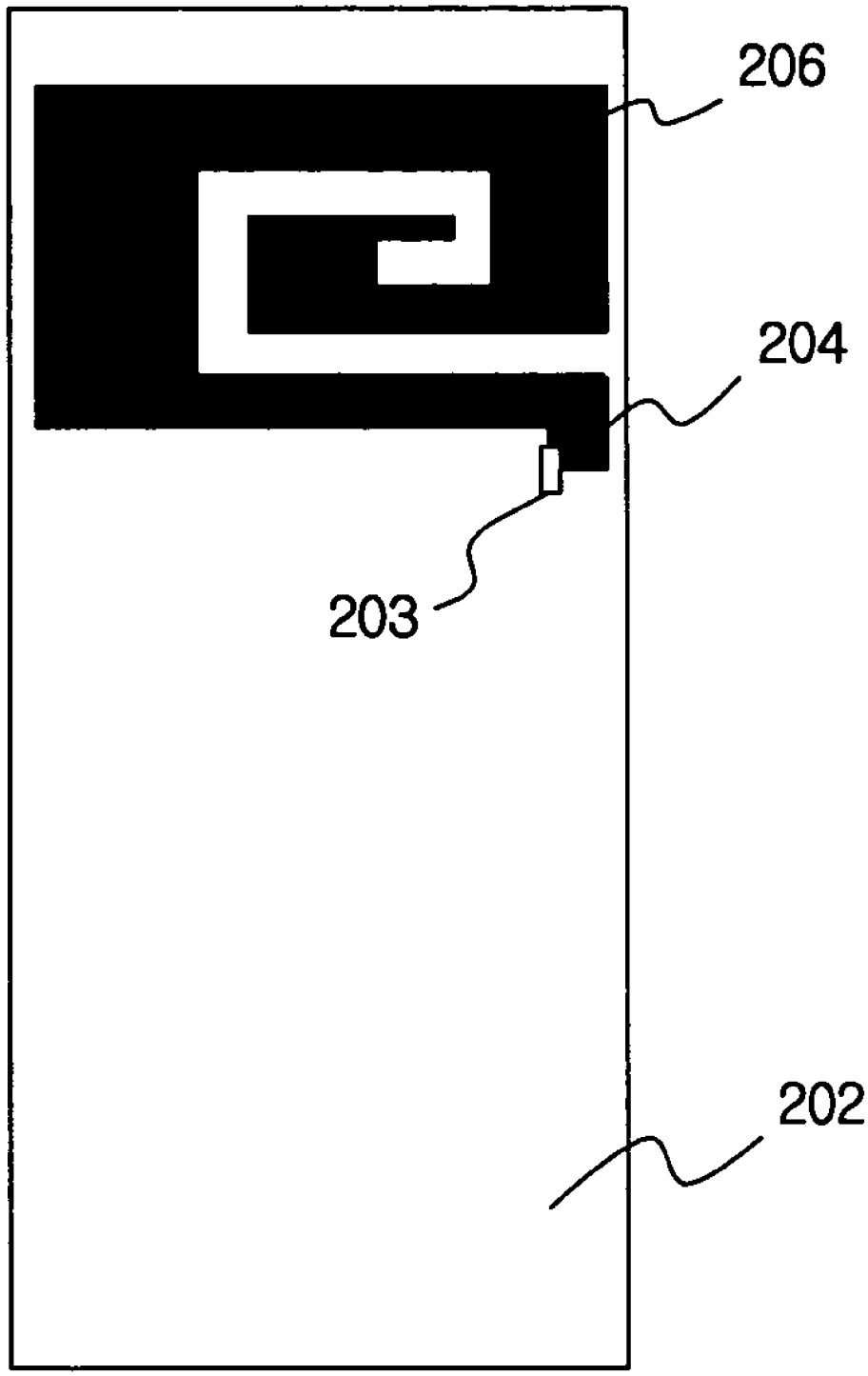

FIGS. 2A to 2C are diagrams the structures of internal antennas.

In the drawings, a spiral-pattered internal spiral antenna having an open stub and existing internal antennas having no an open stub are schematically illustrated.

Referring to FIG. 2A, the internal antenna of the present invention is formed on a printed circuit board 202, and includes a main part 201, that is, a spiral pattern, an open stub 205, a feeding part 203 and a ground part 204. However, referring to FIGS. 2B and 2C, the existing antennas does not include an open stub.

FIG. 2A represents a state in which an antenna having the 1.75-turn spiral pattern 201 of FIG. 1 and an 'n'-shaped open stub 205 is placed on the printed circuit board 202. The antenna 202 excites signals at the upper-right location of the printed circuit board 202. The feeding part 203 and the ground part 204 are adjacent to each other.

Figure 3A:
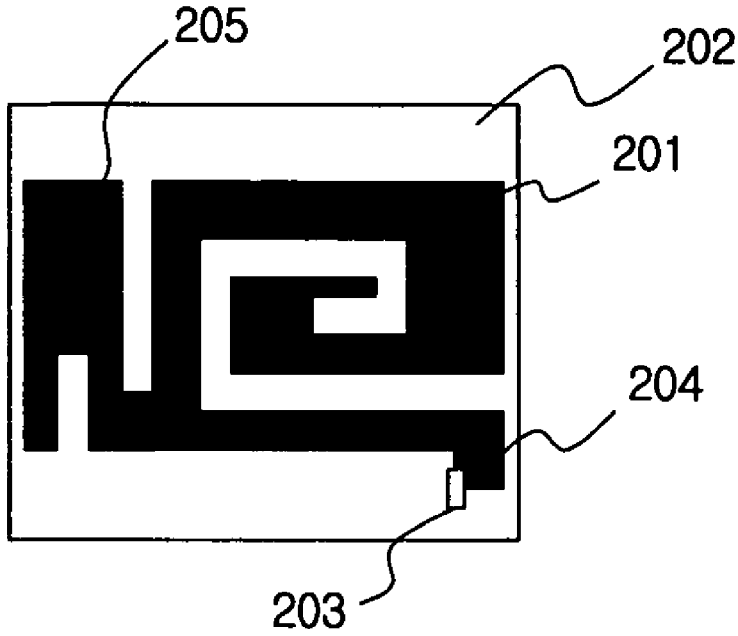
FIGS. 3A and 3B are graphs illustrating characteristics in which resonant frequency decreases or increases depending on an increase or decrease in the length L of the open stub of FIG. 2A according to the embodiment of the present invention.
Figure 3B:
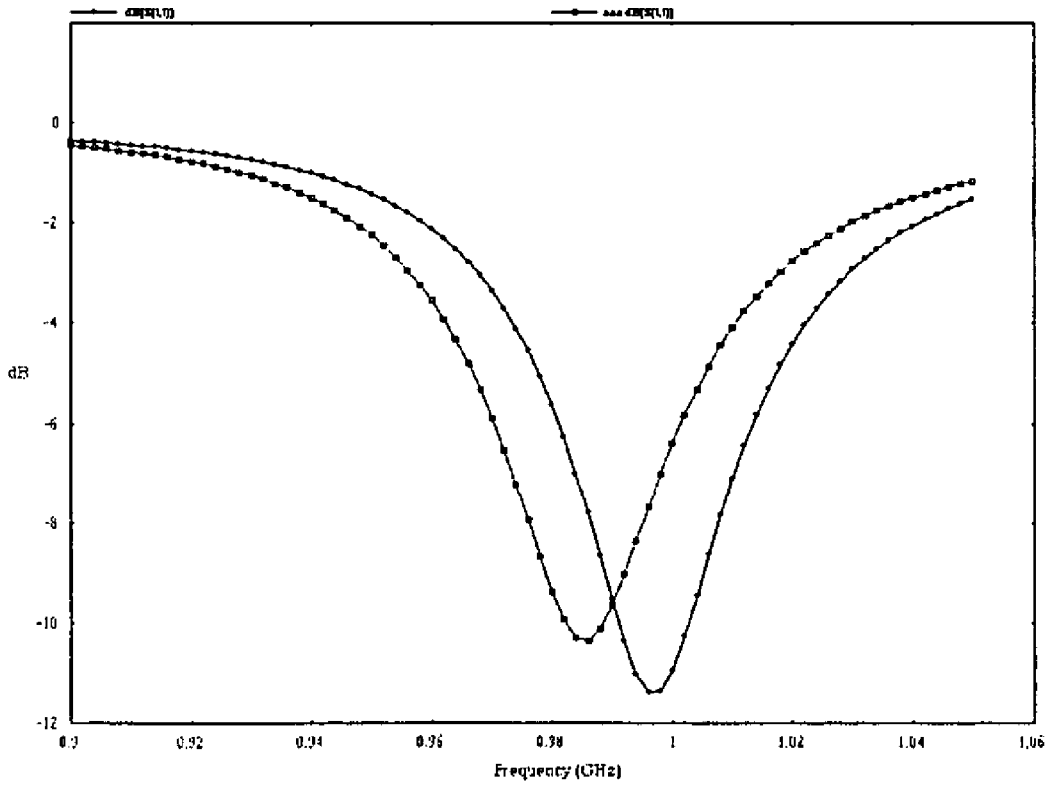

FIGS. 3A and 3B are graphs illustrating characteristics in which resonant frequency decreases or increases depending on an increase or decrease in the length L of the open stub 205 of FIG. 2A according to the embodiment of the present invention.

Referring to FIG. 3A, the length L of the open stub 205 is the vertical length of the open stub 205. Referring to FIG. 3B, when the length L of the open stub 205 is 18.0 mm, resonant frequency is generated at about 0.98 GHz, but when the length L of the open stub 205 is 14.1 mm, resonant frequency is generated at about 1.0 GHz. Therefore, resonant frequency and bandwidth can be adjusted by adjusting the length L of the open stub 205.

FIG. 4 is a table showing the characteristics of the radiation efficiency of the antennas illustrated in FIGS. 2A to 2C.

Referring to FIG. 4, the radiation efficiency of the antenna having the open stub 205 illustrated in FIG. 2A is higher than those of the antennas having only the spiral patterns 206 illustrated in FIGS. 2B and 2C by 10~20%. The efficiency of the antenna sugessted in the present invention is higher than those of antennas implemented using only the spiral patterns illustrated in FIGS. 2B and 2C.

Figure 5C:
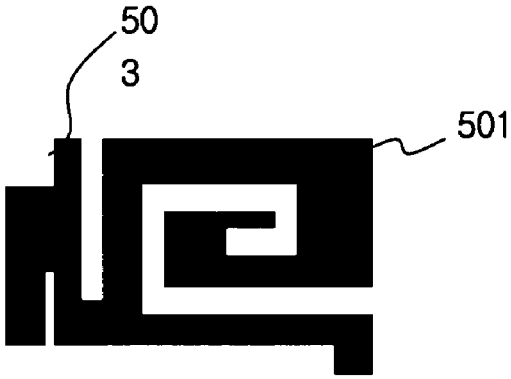

FIGS. 5A to 5C are diagrams illustrating the structures of internal antennas to which various types of open stubs according to embodiments of the present invention are respectively applied.

In the drawings, variations of the open stub depending on the shapes of the rear planes of personal portable terminals and PDAs equipped with internal antennas, are illustrated.

Referring to FIGS. 5A and 5C, spiral patterns 501 forming the main parts of the internal antennas each have 1.75 turns. FIG. 5B illustrates an 'L' shaped open stub 502, and FIG. 5C illustrates an 'n' shaped open stub 503. Those skilled in the art will appreciate that the open stubs 502 and 503 may be variously implemented depending on the appearances of the rear casings of portable telephones, PDAs, and handsets that are equipped with the internal antennas. The rear casings include those of fold-type telephones and flip-type telephones.

Figure 6:
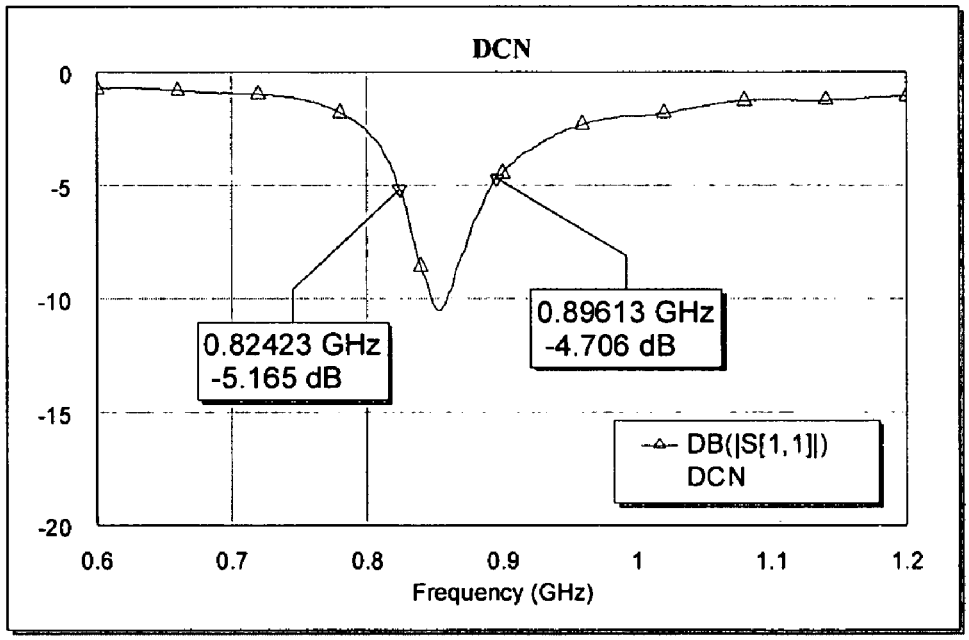
FIG. 6 is a diagram illustrating the measured reflection loss characteristic of the antenna having the shape of FIG. 5A according to the embodiment of the present invention.

FIG. 6 is a diagram illustrating the measured reflection loss characteristic of the antenna having the shape of FIG. 5A according to the embodiment of the present invention. Referring to FIG. 6, a resonance characteristic of about −5 dB is exhibited at a DCN frequency band, that is, 824~894 MHz.

Figure 7:
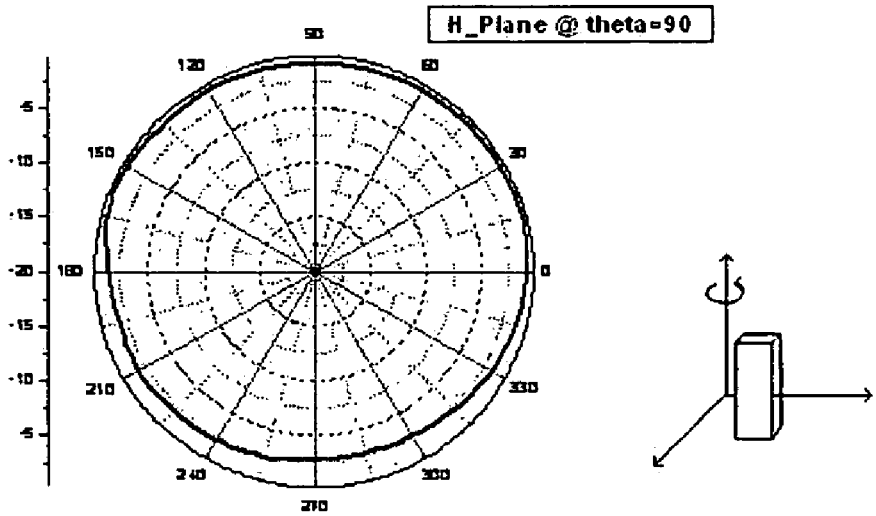
FIG. 7 is a graph illustrating azimuth radiation pattern characteristics according to an embodiment of the present invention.

FIG. 7 is a graph illustrating azimuth radiation pattern characteristics according to an embodiment of the present invention.

In this drawing, the H-plane radiation pattern characteristic of the antenna having the shape of FIG. 5B is illustrated. Referring to FIG. 7, an azimuth radiation pattern, which is omni-directional, is shown around a terminal 701 over 360°.

Figure 8:
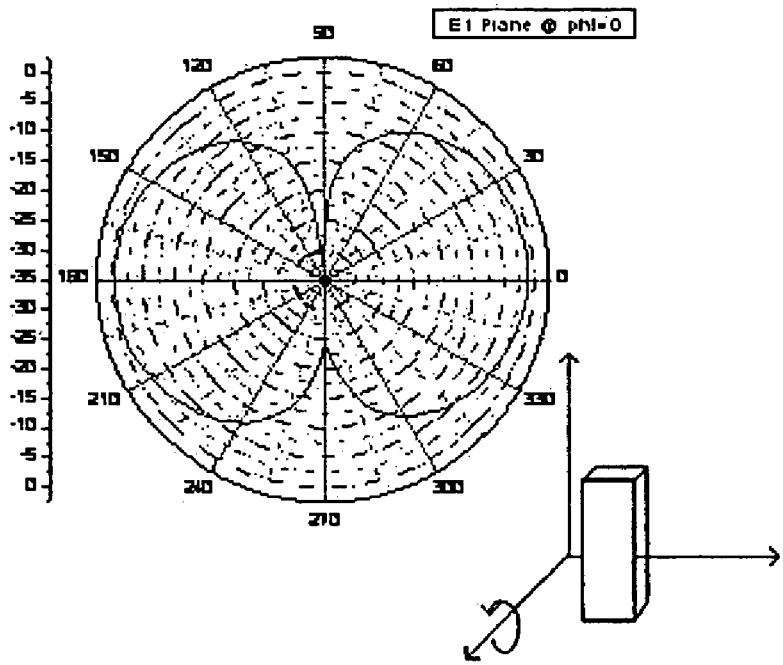
FIGS. 8 and 9 are graphs illustrating azimuth radiation pattern characteristics according to another embodiment of the present invention.
Figure 9:
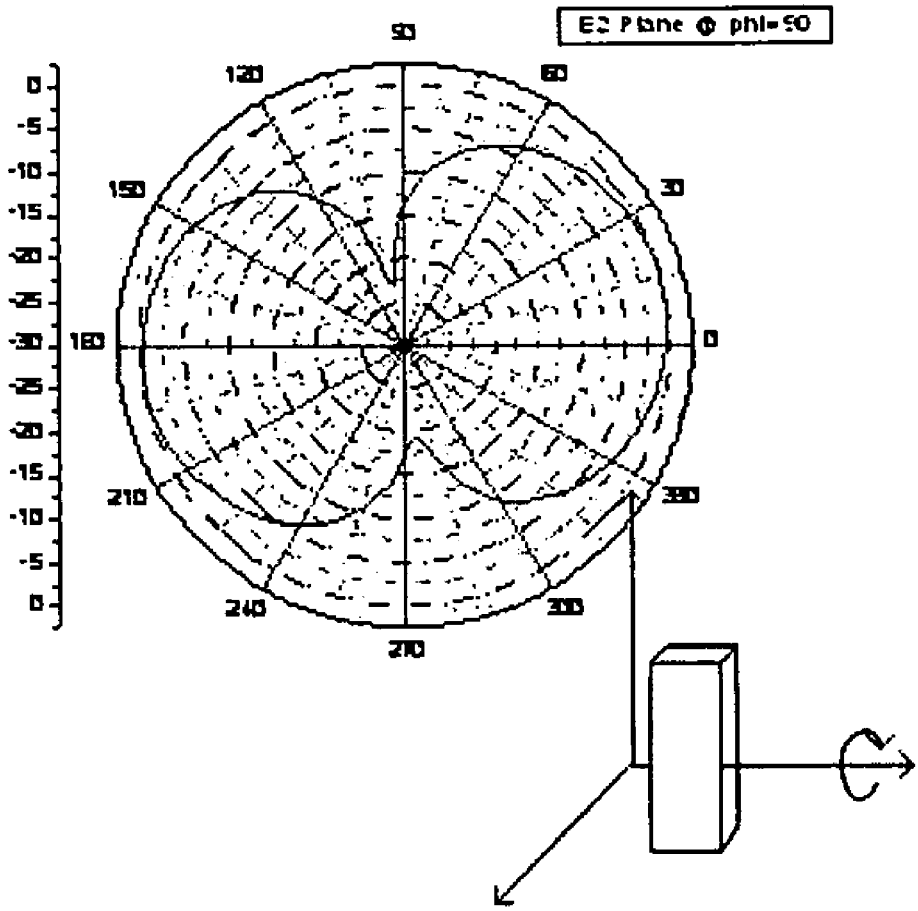

FIGS. 8 and 9 are graphs illustrating azimuth radiation pattern characteristics according to another embodiment of the present invention.

In the drawings, the E1-plane and E2_plane elevation radiation pattern characteristics of the antenna having the shape of FIG. 5B are illustrated. Referring to FIG. 8, '8' shaped radiation pattern is shown around the center of the terminal.

According to the above-described present invention, an antenna for a terminal can be constituted regardless of the shape of a rear casing by using a spiral-patterned antenna having an open stub, and a highly efficient antenna can be formed using the suggested open stub.

Accordingly, a highly efficient antenna can be designed and it can be adapted for small mobile communication terminal-handsets and wireless PDAs desired by users.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A spiral-patterned internal antenna, comprising:

a main part having a spiral pattern;

an open stub connected to an outermost arm of the spiral pattern; and a feeding point located on one side of the main part and connected to an internal circuit of a mobile communication terminal, the feeding point comprising:

a feeding part configured for supplying current to the main part; and a ground part providing an electrical ground of the main part, wherein the feeding part and the ground part are adjacent to each other.

2. The spiral-patterned internal antenna as set forth in claim 1, wherein the spiral pattern of the main part forms 1.5 or more turns.

3. The spiral-patterned internal antenna as set forth in claim 1, wherein the open stub is connected to a 0.5-turn portion of the spiral pattern of the main part.

4. The spiral-patterned internal antenna as set forth in claim 1, wherein the open stub forms a shape selected from 'u', 'n', 'W', '7' and 'L' shapes.

5. The spiral-patterned internal antenna as set forth in claim 1, wherein a length L of the open stub determines a resonant frequency of the antenna.

6. The spiral-patterned internal antenna as set forth in claim 1, wherein an outer shape of the antenna, having the main part with the spiral pattern and the open stub connected to the main part, is determined depending on an appearance of a casing of a mobile communication terminal to be equipped with the main part and the open stub.

7. A mobile terminal, comprising:

a case configured to include a circuit board; and a spiral-patterned internal antenna disposed on the circuit board, comprising:

a main part having a spiral pattern; and an open stub connected to an outermost arm of the spiral pattern; and a feeding point located on one side of the main part and connected to an internal circuit of the mobile terminal, the feeding point comprising:

a feeding part configured for supplying current to the main part; and a ground part providing an electrical ground of the main part, wherein the feeding part and the ground part are adjacent to each other.

* * * * *